US006691824B2

(12) United States Patent
Sharp

(10) Patent No.: US 6,691,824 B2
(45) Date of Patent: Feb. 17, 2004

(54) COMFORTABLE SAFETY HARNESS

(75) Inventor: C. Marty Sharp, Glendale, AZ (US)

(73) Assignee: Ultra-Safe, Inc., Phoenix, AZ (US)

( * ) Notice: Subject to any disclaimer, the term of this patent is extended or adjusted under 35 U.S.C. 154(b) by 0 days.

(21) Appl. No.: 09/976,547

(22) Filed: Oct. 12, 2001

(65) Prior Publication Data

US 2002/0148681 A1 Oct. 17, 2002

Related U.S. Application Data

(60) Provisional application No. 60/240,570, filed on Oct. 13, 2000.

(51) Int. Cl.[7] ..... A62B 35/00
(52) U.S. Cl. ..... 182/3; 182/18
(58) Field of Search ..... 182/3–7, 18, 36

(56) References Cited

U.S. PATENT DOCUMENTS 3,653,075 A * 4/1972 Gluckin
4,209,044 A * 6/1980 Taki ..... 139/411
4,243,118 A * 1/1981 Landry ..... 156/145
5,402,832 A * 4/1995 Kamper
5,598,900 A * 2/1997 O'Rourke ..... 182/18

* cited by examiner

*Primary Examiner*—Alvin Chin-Shue
(74) *Attorney, Agent, or Firm*—Reed Smith Crosby Heafey

(57) ABSTRACT

An improved strap for the construction of safety harnesses of the type designed to protect against falls provides increased flexibility and comfort. The strap is composed of a tubular sheath of elastic fabric that coaxially surrounds a typical high strength safety strap. The two components of the strap are sized so that the safety strap is longer than the surrounding tubular elastic sheath. This causes the longitudinal compression and thickening of the safety strap which then acts as filler to form a "pillow" from the sheath. This cushions the strap making it more comfortable while the longitudinal compression of the enclosed safety strap increases its flexibility. During a fall the sheath rapidly stretches and the enclosed safety strap elongates to full length to stop the fall in the normal manner of safety straps.

7 Claims, 2 Drawing Sheets

COMFORTABLE SAFETY HARNESS

This application claims the benefit of priority from provisional application Serial No. 60/240,570 filed Oct. 13, 2000, which application is incorporated by reference herein in its entirety.

BACKGROUND OF THE INVENTION

1. Area of the Art

The present invention concerns safety devices intended to prevent dangerous falls and more particularly safety harnesses to be worn when working in high places to protect the wearer from an accidental fall.

2. Description of the Prior Art

Safety harnesses are commonly used as part of a fall protection system for persons who must work at heights. In the workplace full-body safety harnesses are often required. Such harnesses, which typically include shoulder straps, can be designed in many alternative manners. For example, U.S. Pat. No. 5,531,292, to Bell discloses a harness with a pair of leg straps, a pair of upper torso straps, a pair of rappelling straps, a seat strap, and four belt suspenders wherein the torso straps include chest strap and back strap portions.

Currently available full-body safety harnesses are generally manufactured from flexible, but relatively inelastic, woven materials such as nylon and polyester. These materials are generally capable of an elastic extension of approximately 1% or less under a tensile load of approximately 10 pounds. Indeed, even at a tensile load of approximately 100 pounds, such materials generally exhibit an elastic extension of approximately 2.5% or less. Although the strength of such materials is suitable for fall protection, the materials are relatively stiff so that harnesses fabricated from such materials impair movement of a worker while in the harness. This impairment often results in discomfort, reduced effectiveness and quick fatigue of the worker. The limited range of motion, discomfort and fatigue associated with current safety harnesses can even result in safety lapses by the worker.

One inventor has provided a partial solution to this problem by disclosing a safety harness constructed from an elastic material (see U.S. Pat. No. 6,006,700 to Cox). It is disclosed therein that providing a harness with limited elastic stretch considerably improves comfort. However, there are still drawbacks. First, the elastic straps necessarily fit snuggly and may chafe. Second, ordinary highly safe strapping material cannot be used because such materials have limited elasticity. This necessitates the use of specially-made elastic strapping material that is more expensive and not necessarily approved by all safety agencies. It would be advantageous if the comfort of elastic strap harnesses could be provided using ordinary safety strap material that is widely available and accepted by all safety agencies.

DETAILED DESCRIPTION OF THE PRESENT INVENTION

The present invention involves the combination of an ordinary elastic material (fabric) with ordinary high-strength safety strap material to produce a comfortable safety harness.

Figure 2:
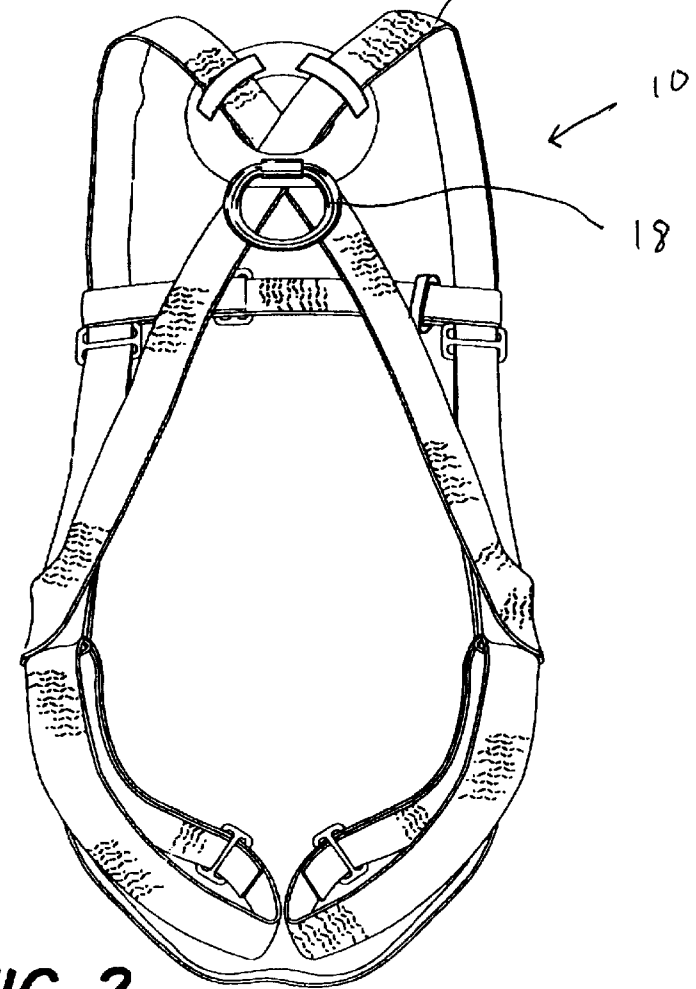
FIG. 2 shows a view of the back of the harness of FIG. 1.
Figure 1:
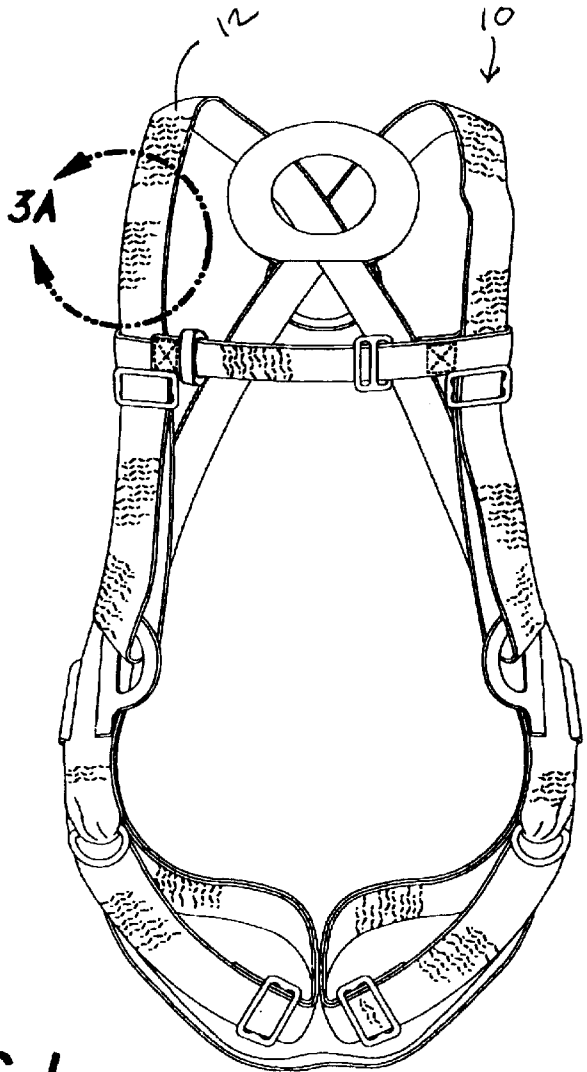
FIG. 1 shows a diagrammatic view of the front of a safety harness employing the present invention.

FIG. 1 and FIG. 2 show a front and back view, respectively, of a safety harness 10 incorporating the present invention. For all intents and purposes this appears like any ordinary safety harness with the possible exception that the straps 12 have a slightly "wrinkled" or "puckered" appearance. The invention is not limited to a harness of this configuration but can be applied to essentially any safety harness where the harness straps encircle at least a portion of the human body so that the wearer would benefit from the additional comfort of elastic harness straps.

Figures 3A, 3B, 3C, 3D, 3E:
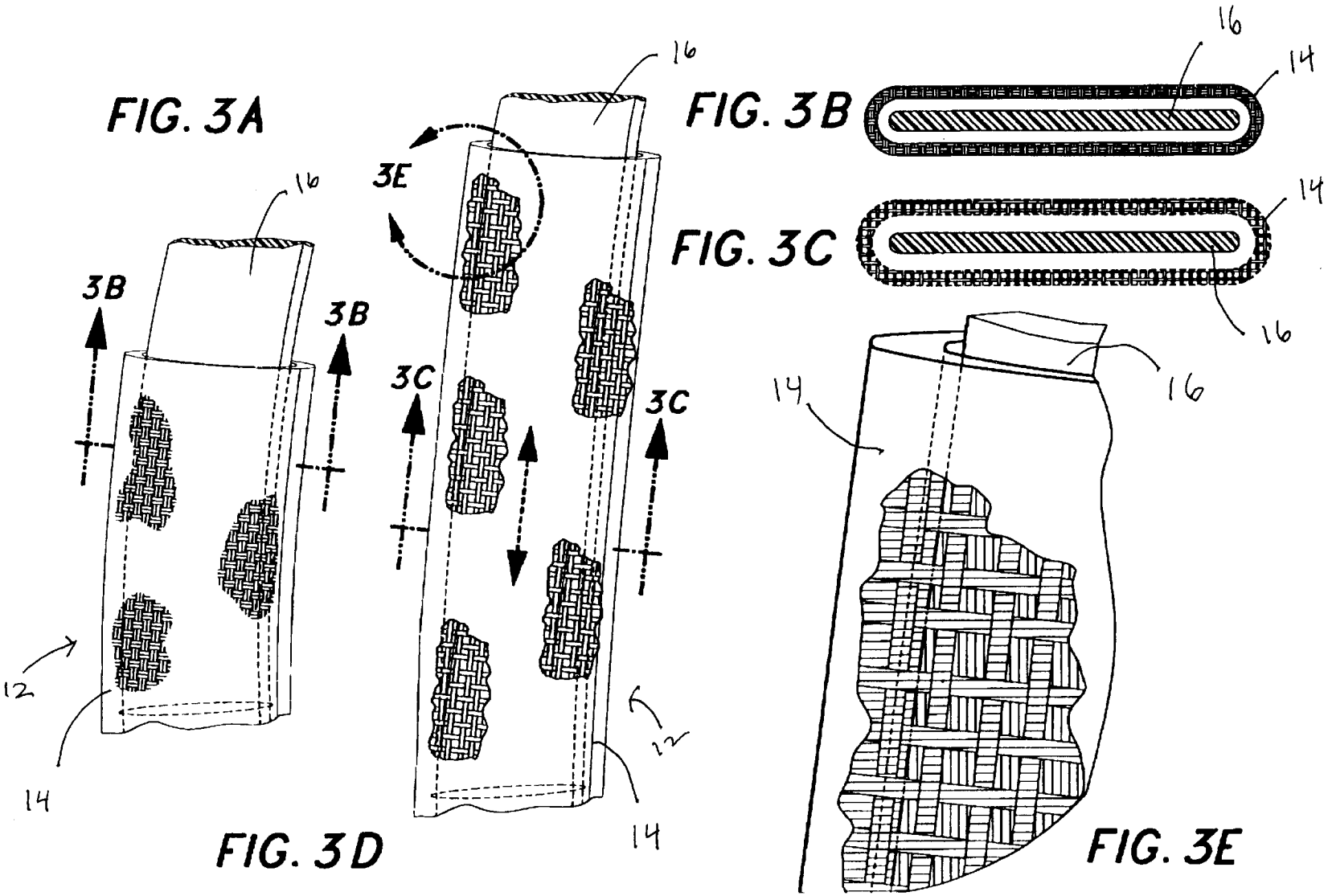
FIG. 3A shows a cut-away longitudinal view of a strap of the present invention in its original form.
FIG. 3B shows a cross-sectional view of the strap of FIG. 3A.
FIG. 3C shows a cross-sectional view of the strap of FIG. 3D.
FIG. 3D shows a cut-away longitudinal view of the strap of FIG. 3A after having been stretched by the force of a fall.
FIG. 3E shows a close up view of a portion of FIG. 3D showing the inner strap showing through the stretched outer sheath.

FIGS. 3A and 3B show detailed views of the inventive straps 12 of the invention. Each strap 12 is actually a composite structure. An outer tubular sheath 14 surrounds an inner strap 16 (shaded with diagonals in FIG. 3B). The inner strap 16 comprises an ordinary, high strength safety strap well known to those of ordinary skill in the art. The outer tubular sheath 14 is a tubular elastic material of relatively low strength. The elastic material is similar to that found in suspenders and similar apparel. The elastic material can be elongated at least 5% by application of a force no greater than ten pounds. The sheath 14 can be either manufactured (knit) as a tube or be sewn from a flat strap (with a longitudinal seam). The tubular elastic sheath 14 and the inner safety strap 16 are combined so that the elastic sheath is under some tension (i.e., it is stretched). The sheath 14 and the inner strap 16 are measured so that the sheath is approximately the same length of the inner strap 16 when the sheath 14 is fully stretched. When the sheath is released, it contracts causing the now longer inner strap 16 to "bunch up". That is, contraction of the elastic sheath 14 compresses the inner safety strap 16 longitudinally causing it to form slight lateral wrinkles, which act as stuffing within the "pillow case" of the sheath 16. This pillow structure provides increased padding and makes the harness comfortable even when in contact with bare skin.

When the wearer bends or flexes, the elastic sheath 14 stretches allowing easy movement. Because the internal safety strap 16 is longitudinally compressed, it becomes more flexible than usual. If the wearer falls, the harness will be supported by a safety strap 12 attached, for example, to the ring 18 shown in FIG. 2. In such a case the sudden force of the fall (e.g., the force representing the wearer's mass accelerated by gravity acting on the safety harness 10) will be borne by the internal safety strap 16 that rapidly elongates to its full length. The force of the fall stretches the tubular sheath 16 to its full length. Actually, safety straps 16 are designed to elongate plastically during a fall so as to absorb part of the kinetic energy of the falling wearer and cushion the wearer against rapid deceleration. That is, the safety strap becomes irreversibly stretched by the application of excess force. After a severe fall this plastic elongation will compromise the strength of the safety strap so that the harness should not be used again.

In the past various indicator devices have been employed to prevent the reuse of stretched safety straps since such straps might not survive a second fall. The present invention also provides such an indicator system. As shown in FIG. 3D, when the internal safety strap 16 elongates plastically, the outer elastic sheath 14 becomes over-stretched. This causes the weave of the material to open (as also shown in FIG. 3C). When the weave opens, it allows the inner safety strap to show through (see FIG. 3E). By selecting a bright or contrasting color for the inner safety strap an indicator is formed. For example if the inner safety strap is red or orange and the outer tubular elastic sheath is a neutral color like tan, the whole strap will appear to turn red or orange when the harness has been stressed and should no longer be used. Various other indicating color combinations are possible and will be apparent to those of ordinary skill in the art. If the tubular elastic sheath is blue and the safety strap is red, a purple color will indicate an unsafe harness, etc.

The present invention has been described to enable any person of ordinary skill to make a comfortable safety harness by taking an ordinary safety harness and covering the straps thereof with a tubular elastic material. The tubular elastic material is sized so that the enclosed straps are longer than the tubular material and become longitudinally compressed so as to slightly bulk up and fill the "pillow" of the elastic sheath.

I claim:

1. A compound strap for a safety harness comprising:

a continuous inner strap of high strength safety material; and a tubular sheath strap of elastic material coaxially surrounding the inner strap, wherein the tubular sheath strap and the inner strap are substantially unconnected to one another along their lengths and wherein a length of the inner strap is greater than an unstretched length of the surrounding tubular sheath strap wherein said length of the inner strap is substantially equal to said length of the surrounding tubular sheath strap when the tubular sheath strap is stretched so that when the tubular sheath strap is not stretched, the inner strap is longitudinally compressed by the tubular sheath strap adding cushioning to the compound strap.

2. A safety harness including a length of the compound strap of claim 1.

3. The compound strap of claim 1 wherein the inner strap is of a color different from the outer tubular sheath strap, and wherein stretching of the inner strap results in deformation of the outer tubular sheath strap allowing the inner strap to be visualized therethrough.

4. A compound strap for a safety harness comprising:

an outer tubular sheath strap of elastic material; and a continuous inner strap of high strength safety material of a color different from the outer tubular sheath strap, coaxially surrounded thereby and substantially unconnected thereto along their respective lengths and, wherein a length of the inner strap is greater than an unstretched length of the surrounding tubular sheath strap, wherein said length of the inner strap is substantially equal to said length of the surrounding tubular sheath strap when the tubular sheath strap is stretched so that when the tubular sheath strap is not stretched, the inner strap is longitudinally compressed by the tubular sheath strap adding cushioning to the compound strap, and wherein stretching of the inner strap results in deformation of the outer tubular sheath strap allowing the inner strap to be visualized therethrough.

5. A safety harness including a length of the compound strap of claim 4.

6. The compound strap according to claim 1, wherein the tubular sheath strap becomes stretched by a force of ten pounds.

7. The compound strap according to claim 4, wherein the tubular sheath strap becomes stretched by a force of ten pounds.

* * * * *